US009174486B2

(12) United States Patent
Planavsky

(10) Patent No.: US 9,174,486 B2
(45) Date of Patent: Nov. 3, 2015

(54) BOWCHALK

(71) Applicant: Derek Nicholas Planavsky, Natrona Heights, PA (US)

(72) Inventor: Derek Nicholas Planavsky, Natrona Heights, PA (US)

( * ) Notice: Subject to any disclaimer, the term of this patent is extended or adjusted under 35 U.S.C. 154(b) by 124 days.

(21) Appl. No.: 14/138,087

(22) Filed: Dec. 22, 2013

(65) Prior Publication Data

US 2015/0174948 A1 Jun. 25, 2015

(51) Int. Cl.
*B44D 3/38* (2006.01)

(52) U.S. Cl.
CPC ..... *B44D 3/38* (2013.01)

(58) Field of Classification Search
CPC ..... B44D 3/38
USPC ..... 33/1 LE, 413, 414
See application file for complete search history.

(56) References Cited

U.S. PATENT DOCUMENTS

| | | | | |
|---|---|---|---|---|
| 1,505,286 | A * | 8/1924 | Peterson | 33/414 |
| 4,141,146 | A * | 2/1979 | Broom | 33/413 |
| 8,819,949 | B2 * | 9/2014 | Fritsch et al. | 33/414 |
| 2006/0096107 | A1 * | 5/2006 | Hickey et al. | 33/414 |
| 2008/0301959 | A1 * | 12/2008 | Nepil et al. | 33/414 |
| 2014/0007440 | A1 * | 1/2014 | Cain | 33/413 |

* cited by examiner

*Primary Examiner* — G. Bradley Bennett

(57) ABSTRACT

A specially designed line marking device includes a marking string that is attached to a bow-shaped support structure with no free end for conveniently use by a single operator, a shuttle for coating the marking string with marking media prior to use, allowing an operator to effectively use this marking device and snap a marking line onto a working surface without the assistance of an additional operator, and a movable carriage containing liquid, powder, or aerosol marking media to be sprayed or deposited along said marking string, creating an inverse image of the marking string.

20 Claims, 18 Drawing Sheets

BOWCHALK

REFERENCE TO RELATED APPLICATIONS

This patent application claims the benefit of U.S. Provisional Application No. 61/751,601 filed on Jan. 11, 2013, the disclosure of which is incorporated herein by reference in its entirety.

BACKGROUND OF THE INVENTION

Field of the Invention

Workers must often mark or herein after referred to as "draw" straight lines accurately to minimize waste in cutting construction materials, and to ensure that materials will be properly fastened. A chalk line is a marking tool for marking straight lines on a surface. A chalk line draws straight lines using a tightly drawn string. Specifically, the string, coated or impregnated with chalk or a loose dye, is drawn across the surface to be marked, and is then "snapped" to cause the string to strike the surface, marking a straight line. It is an important tool in carpentry, painting, construction, roofing, framing, surveying and other mechanical arts which require a straight line.

Typically, a chalk line marking device has a chalk line carrying a ring or hook or clip at its free end to anchor at an edge of a surface to mark. Some examples of chalk line marking devices are disclosed in U.S. Pat. No. 2,589,500 to Linden et al., U.S. Pat. No. 4,143,462 to Gertz, U.S. Pat. No. 4,819,337 to Noyes. Nevertheless, it is inconvenient when using such a line marking device to mark a line on a surface which does not have an edge to locate. Besides, these line marking devices are relatively expensive or complicated to construct or utilize.

Therefore, it is necessary to have an improved and cost-effective line marking device that can enable one single operator to apply mark lines on surfaces that do not have conveniently located edges.

SUMMARY OF THE INVENTION

The present invention provides a specially designed line marking device which includes a marking string attached to a bow-shaped support structure, a means for coating the line with marking substance (chalk) prior to use, allowing an operator to effectively use this marking device and snap a marking line onto a working surface without the assistance of an additional operator. Potential uses of the line marking device include marking lines on walls, ground, concrete, roofing, floors, and ceilings.

An aspect of the present invention is to provide a line marking device comprising a main support structure, a marking string supported by the main support structure, and a bullet or shuttle which is slidably connected in relation to the marking string for impregnating the marking string with a marking substance.

In one embodiment of the invention, the main support structure of the line marking device lies in a plane perpendicular to the surface to be marked, and above the marking string in relation to the marking surface.

A further aspect of the present invention is to provide a shuttle or bullet that, when placed in relative motion with a marking string, impregnates the marking string with marking media. Relative motion can incorporate moving the marking string through or along a fixed bullet or shuttle, or can incorporate moving the bullet or shuttle around or along a fixed marking string.

In one embodiment of the invention, the bullet or shuttle may comprise a structure which can be attached in a breakaway or removable configuration to facilitate replacement or replenishment of marking media. In a further embodiment, the bullet or shuttle may comprise structure which can be fixedly attached around a marking string in a manner which does not permit removal.

In one embodiment of the invention, the bullet or shuttle can comprise marking solid chalking or marking media for impregnating a marking string when moved relative to the line. In a further embodiment of the invention, the bullet or shuttle which comprises liquid or powder marking media within an absorbent material which, when in relative motion with a marking string, can impregnate the marking string with the marking media.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 8 also shows an additional means for marking a surface with a moveable carriage that can be moved along guide wires to mark a surface along the marking string beneath it.

DESCRIPTION OF THE PREFERRED EMBODIMENT

Figure 1:
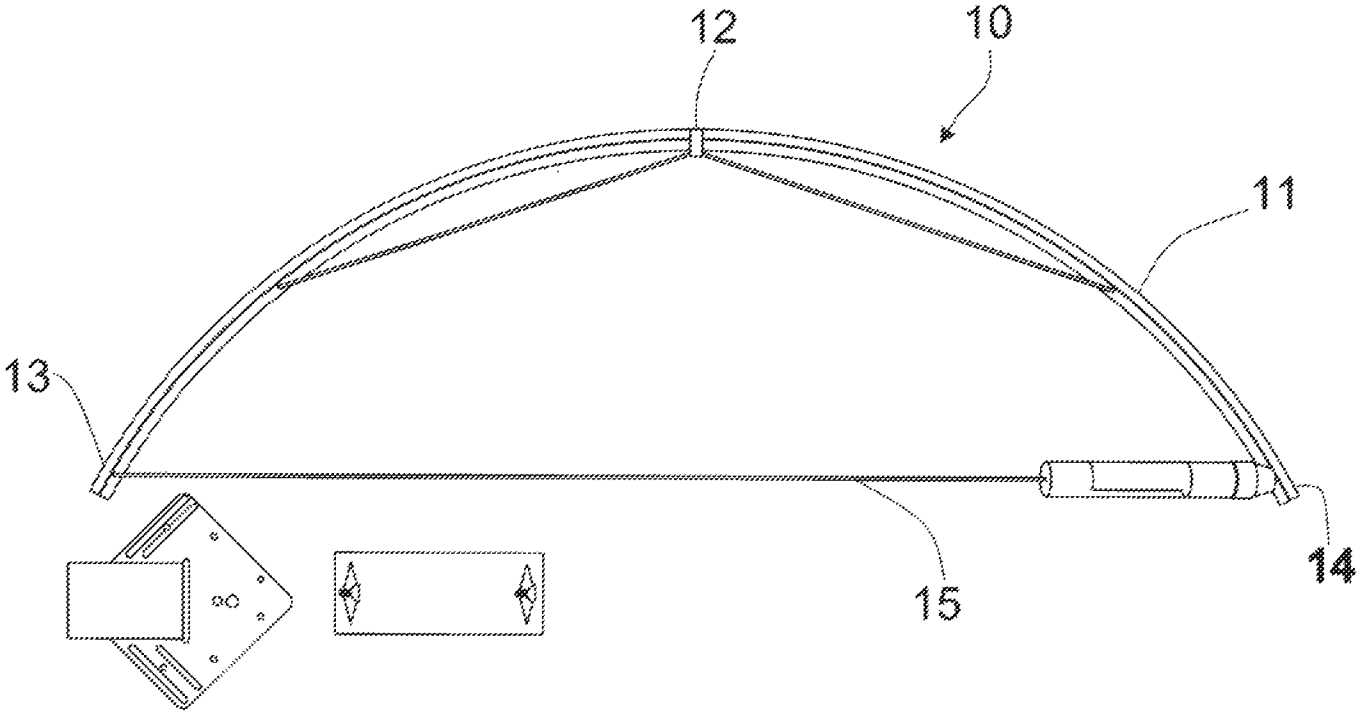
FIG. 1 is a side view of a line marking device according to a preferred embodiment of the present invention. The embodiment shown in FIG. 1 shows a fully assembled line marking device including a continuous marking string, a bow-shaped support structure, a shuttle or bullet which is fixed to one end of the support structure, and shows a dissembled view of a horizontal support surface which may be fixed to another end of the support structure.

FIG. 1 depicts a side view of one embodiment of a line marking device generally designated by the reference numeral 10. The device is held together primarily by a bow-shaped main support structure 11 with an apex 12 and first 13 and second 14 ends. A continuous marking string 15 with no loose ends can be slidably attached to the main support structure in at least three points comprising the first and second ends and the apex, with at least one portion opposite the apex forming a straight line that may be used for marking a surface. The marking string 15 forms a closed loop with no loose ends, and may be attached in a manner that allows the operator to pull the line through a bullet or shuttle 16 containing marking media. A bullet or shuttle 16 can be fixed at the second end 14 of the bow-shaped support structure, and encloses the continuous marking string in a manner that coats the marking string with marking media as the marking string passes through the center of the bullet or shuttle. A horizontal placement bracket or support surface 18 can be attached at the first end of the bow-shaped support structure 11 which allows an operator to easily place the line marking device in a flat or level position for line marking. The horizontal placement bracket 18 can be placed such that a flat surface on a bottom edge of the placement bracket lies in a plane perpendicular to the line marking device, and parallel to the surface to be marked.

Figure 2:
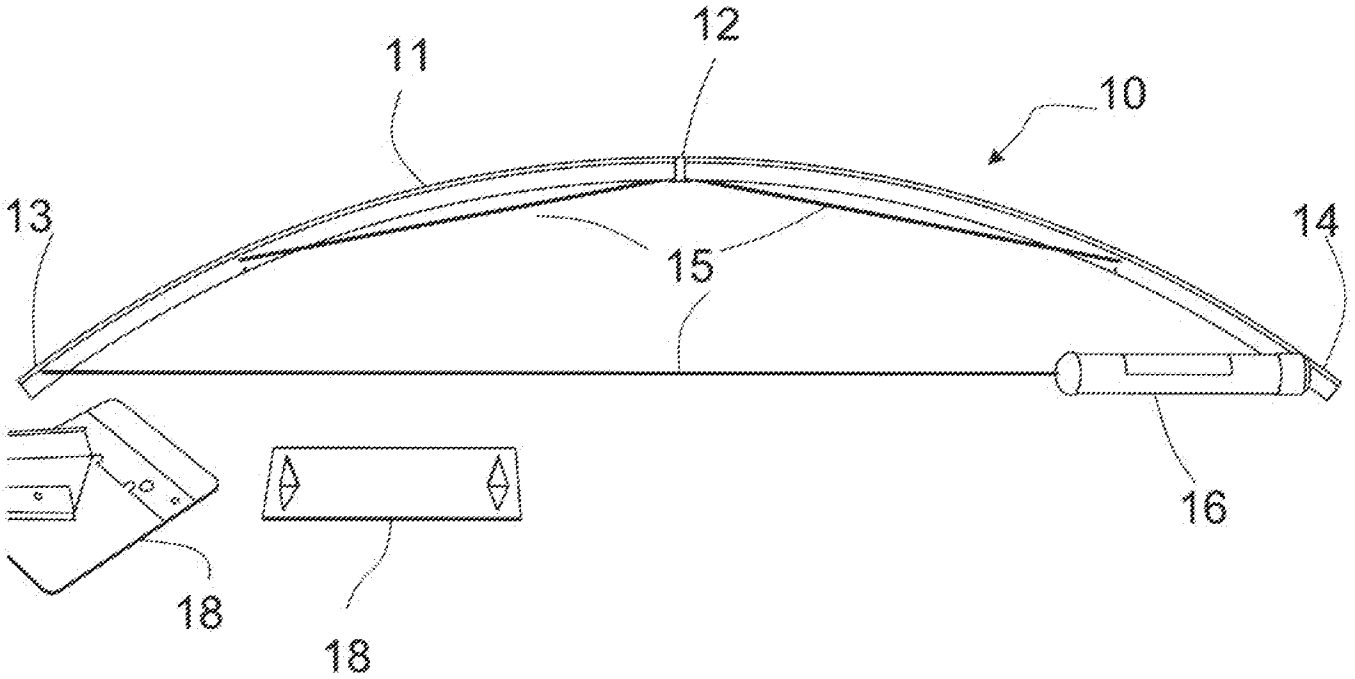
FIG. 2 is a side elevation view of the line marking device of FIG. 1, showing the fully assembled device with slidably attached continuous marking string, fixed position shuttle or bullet, bow-shaped support structure, and dissembled horizontal support surface for engaging a surface to be marked.

FIG. 2 depicts an elevated side view of one embodiment of a line marking device. FIG. 2 shows how the continuous marking string 15 can be slidably attached to the bow-shaped support structure in order to pass through the shuttle or bullet 16 which can be made up of or which can be loaded with marking media.

Figure 3:
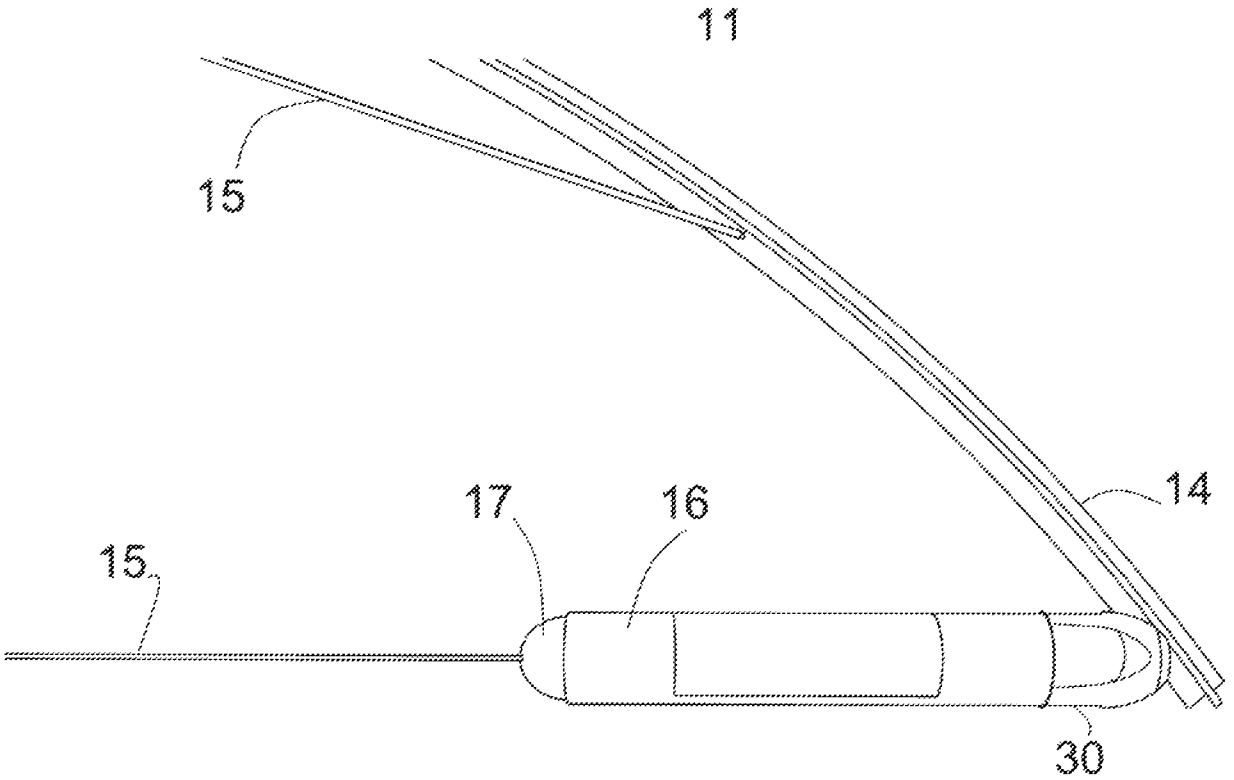
FIG. 3 is a side view of the shuttle or bullet device fixed to the second end of the line marking device of FIG. 1, showing the general exterior structure of the bullet or shuttle as it is fixed to one end of the bow-shaped support structure in a slidably fixed relationship to the continuous marking loop.

FIG. 3 shows a larger view of a shuttle or bullet 16 in one embodiment of a line marking device. In one embodiment, the shuttle or bullet 16 can be fixed to the second end 14 of the bow-shaped support structure 11 in a manner that might allow the continuous marking string 15 to pass through the center. In one embodiment, the shuttle or bullet can be made of a solid marking material for direct deposition of marking media onto the continuous marking string. In another embodiment, the shuttle or bullet can contain a powdered or liquid marking media, which can be imparted onto the continuous marking string as the marking string passes through the shuttle or bullet. In an embodiment wherein the bullet or shuttle contains liquid or powdered marking media, the bullet or shuttle may have a soft or spongy material in each open end in order to prevent free pouring of marking media, and to maintain the lateral position of the shuttle along the marking string.

Figure 4:
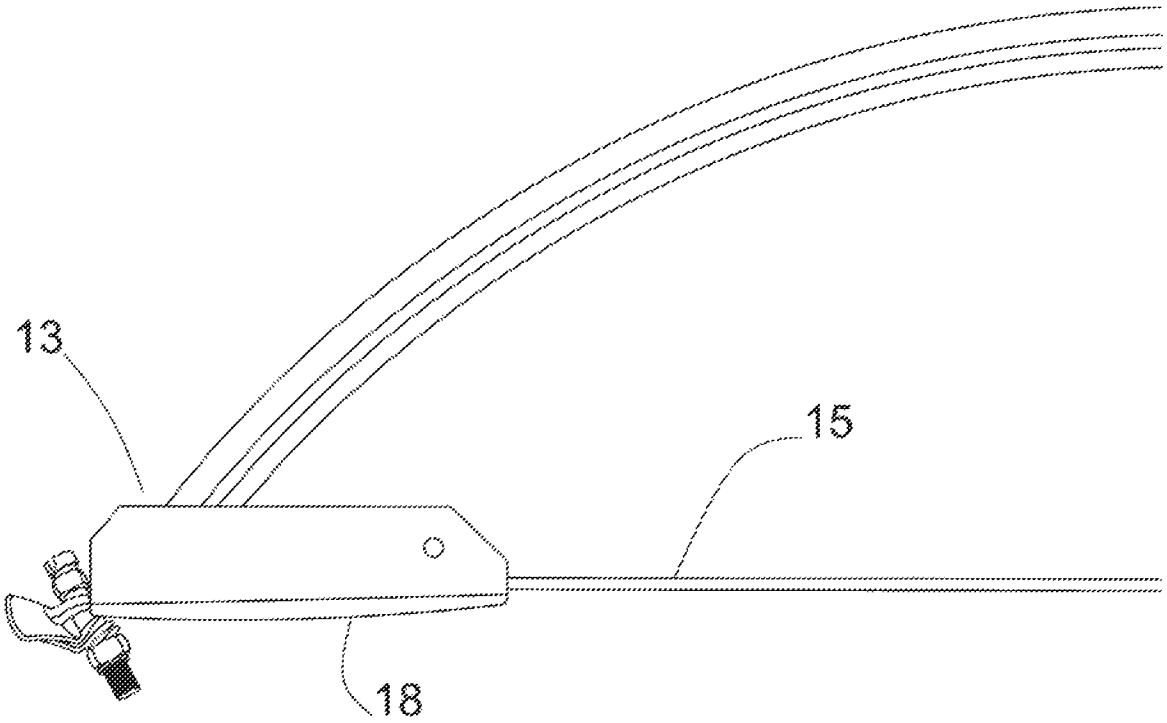
FIG. 4 is a side view of the first end of the line marking device of FIG. 1, depicting the horizontal mounting bracket attached to the first end of the line marking device.

FIG. 4 depicts a close-up side view of a horizontal placement bracket or horizontal support surface 18, which in one embodiment can be attached to the first end of the bow-shaped support structure. The horizontal placement bracket 18 can serve to prevent marking of a surface before the continuous marking string is purposely engaged with the surface to be marked. The horizontal placement bracket can also serve to provide a flat or level area with which to engage the surface to be marked to facilitate the operation of marking.

Figure 5:
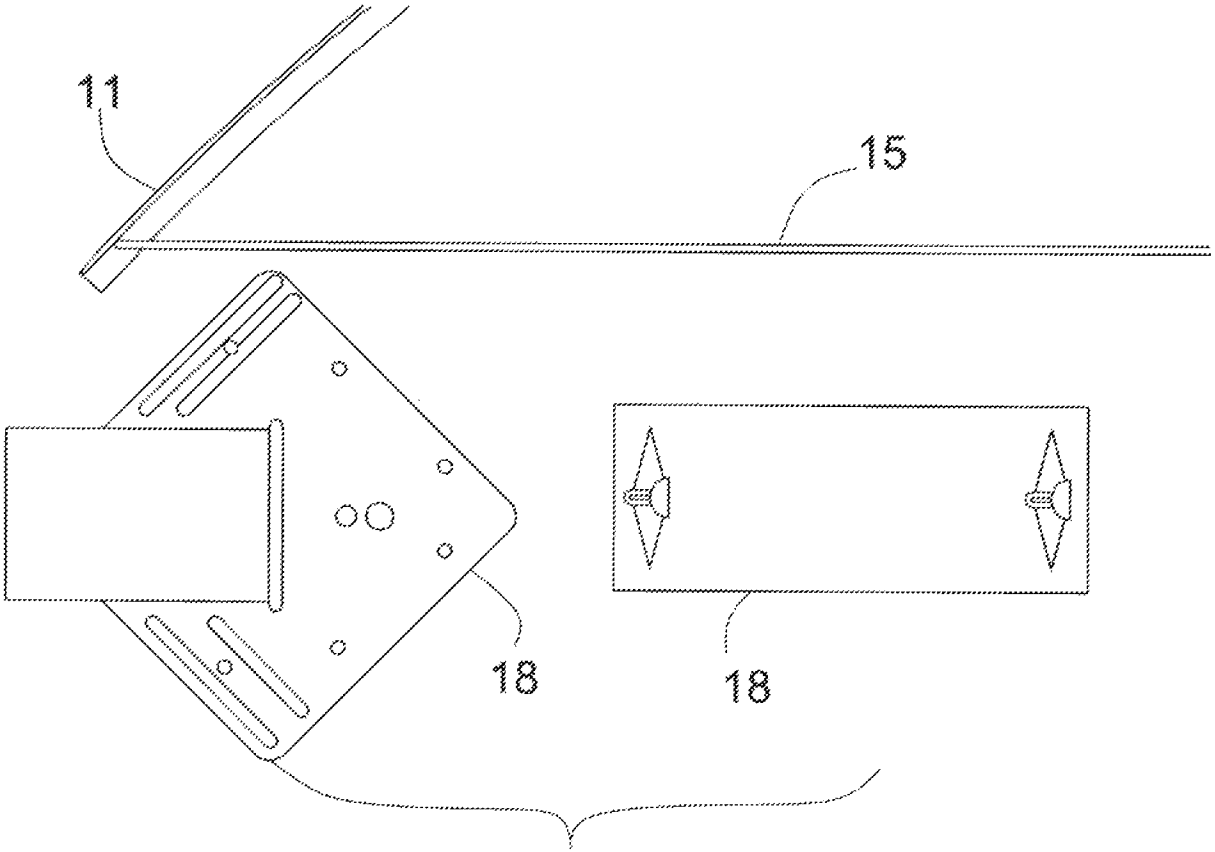
FIG. 5 is a partially dissembled side view of the first end of a preferred embodiment of the present invention, showing possible embodiments of the horizontal support surface for engaging a surface to be marked.

FIG. 5 depicts a partially exploded side view of the first end of an embodiment of the line marking device. In differing embodiments, the shape and structure of the horizontal placement bracket 18 can vary, and may include a larger, square or diamond shape, or may include a narrower, rectangular shape. In this way said device is able to adapt to different concrete surfaces for different stages in the cutting process. This flexibility allows for the reduction of error and furthermore also allows for an accurate and rather easy process of alignment as needed.

Figure 6:
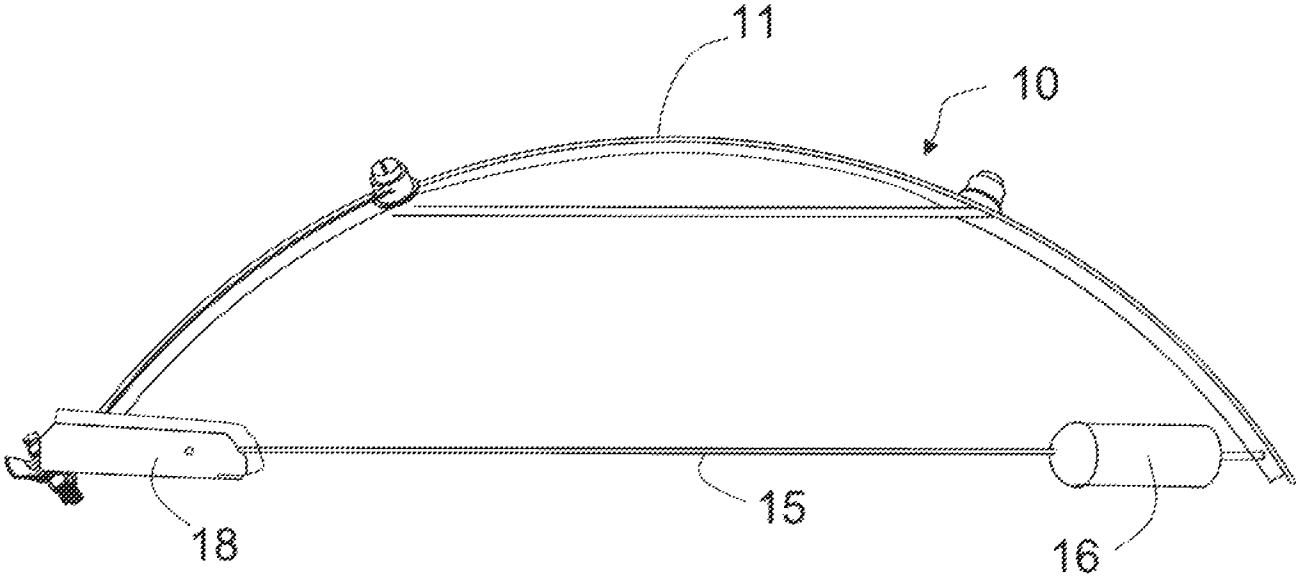
FIG. 6 is a side view of a line marking device according to a second preferred embodiment of the present invention, showing a bow-shaped support structure for a fixed position marking string, a horizontal support surface on one end, and a shuttle or bullet slidably placed along the marking string for impregnating the marking string with marking media.

FIG. 6 depicts a side view of a second embodiment of a line marking device 10. The device is held together primarily by a bow-shaped main support structure 11 with an apex 12 and first 13 and second 14 ends. A marking string 15 can be fixedly attached to the main support structure in at least two points comprising the first and second ends. At least one portion of the marking string forms a straight line between the first and second ends which may be used to mark a surface. A bullet or shuttle 16 can be slidably placed along the marking string enclosed around the marking string 15 in a manner that coats the marking string with marking media as the bullet or shuttle 16 slides along the line. A horizontal placement bracket 18 can be attached at the first end of the bow-shaped support structure which allows an operator to easily place the line marking device in a flat or level position for line marking. The horizontal placement bracket 18 can be placed such that a flat surface on a bottom edge of the placement bracket lies in a plane perpendicular to the line marking device, and parallel to the surface to be marked.

Figure 7:
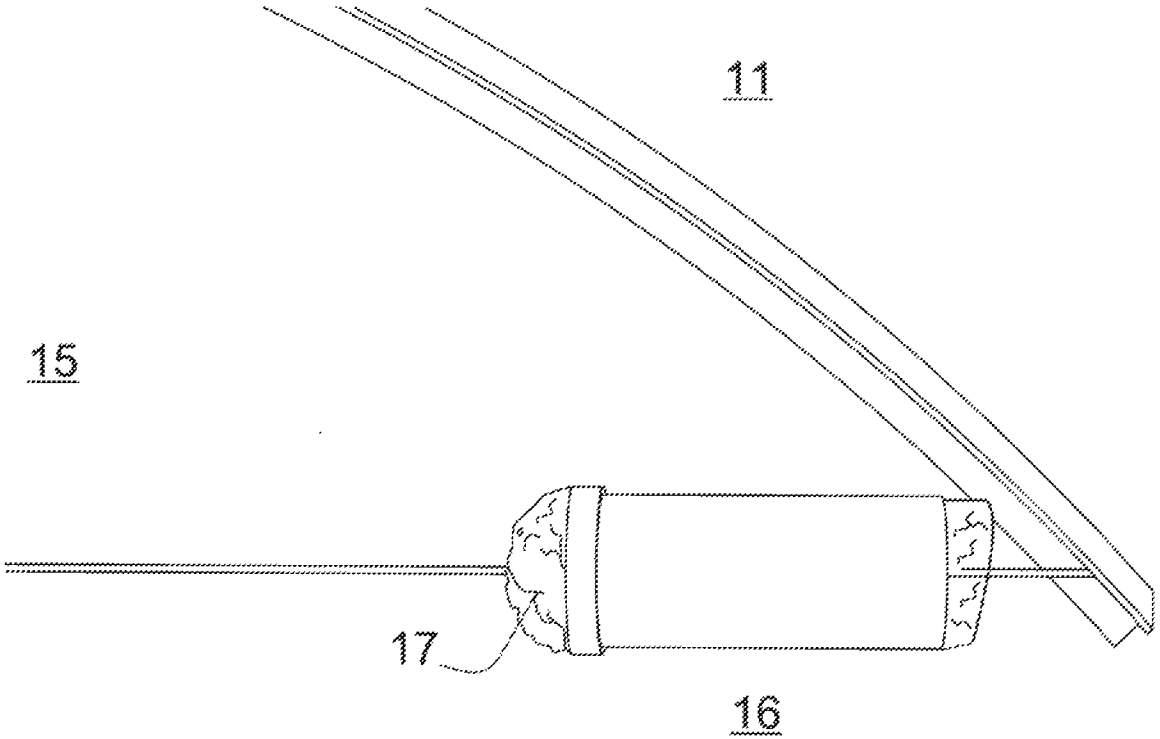
FIG. 7 is a side view of the shuttle or bullet device placed at the second end of the line marking device, slidably joined to the marking string of the line marking device of FIG. 6.

FIG. 7 depicts an embodiment of the bullet or shuttle 16 wherein the bullet or shuttle is slidably placed such that the marking string 15 runs through the center of the bullet or shuttle. The inner portion or shuttle can comprise or contain solid, liquid, or powder marking media such that sliding the bullet or shuttle along the will impregnate the marking string with marking media. Once impregnated with marking media, the marking string in such embodiment would place a line on a surface when snapped by the operator.

The bullet serves to clean the line (memory foam cleans the line as it passes across the line) and also serves to chalk the line. Such bullet device is able to move along the line and is refillable as needed.

In some embodiments, the bullet or shuttle can be formed in a manner that allows it to be opened or detached to facilitate interchangeability. Such interchangeability facilitates reloading or replacement of marking media when marking media becomes depleted. In other embodiments the bullet or shuttle can be integrally formed around the marking string without means for removal. In some embodiments, the marking media contained within the bullet or shuttle may comprise a solid chalking device which impregnates the marking string when the bullet or shuttle and marking string are moved relative to one another. In another embodiment, the bullet or shuttle can contain liquid or powder marking media within an absorbent material or within a hollow shell. In an embodiment wherein the bullet or shuttle contains liquid or powdered marking media in a hollow shell, each open end of the bullet or shuttle may be closed with a soft or spongy material which prevents free pouring of the marking media and prevents lateral movement of the shuttle in directions other than parallel to the marking string.

Figure 8:
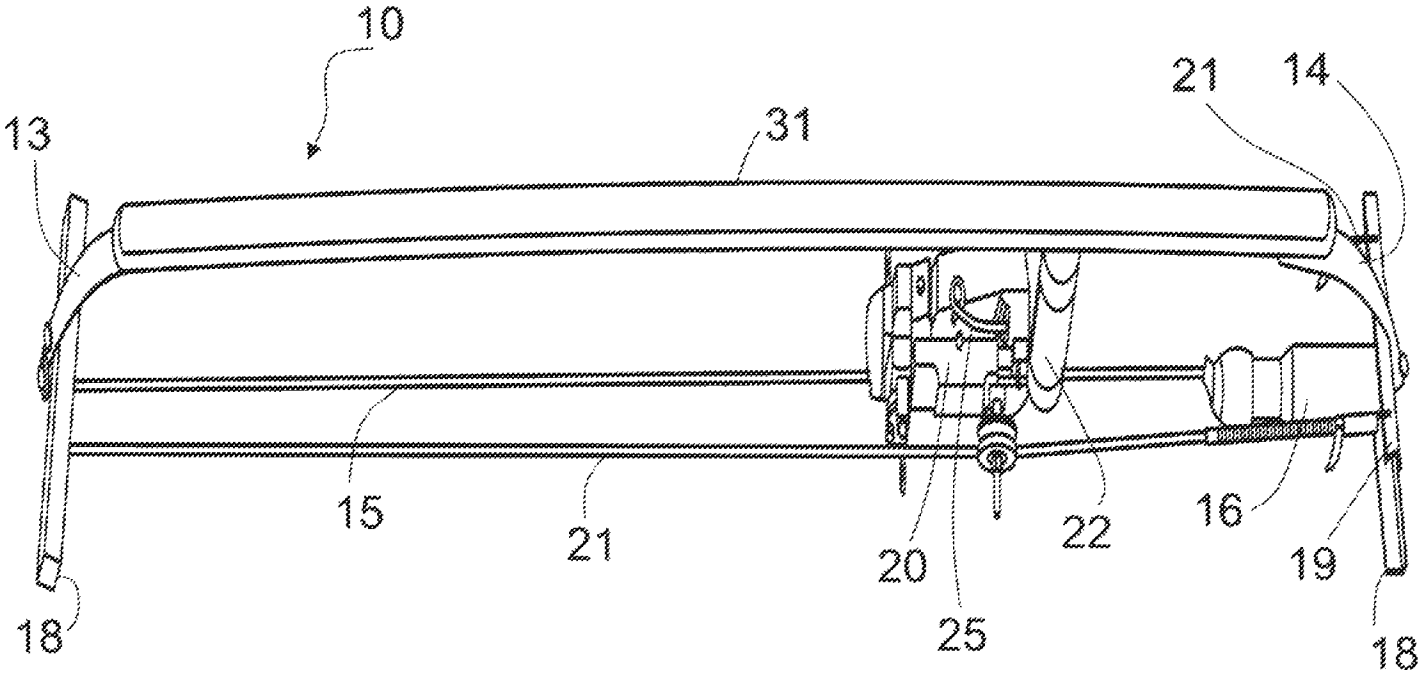
FIG. 8 is an isometric top-down view of a third preferred embodiment of the line marking device showing an elongated bow-shaped support structure which incorporates a fixed marking string with a bullet or shuttle that is slidably placed along the marking string.
Figure 9:
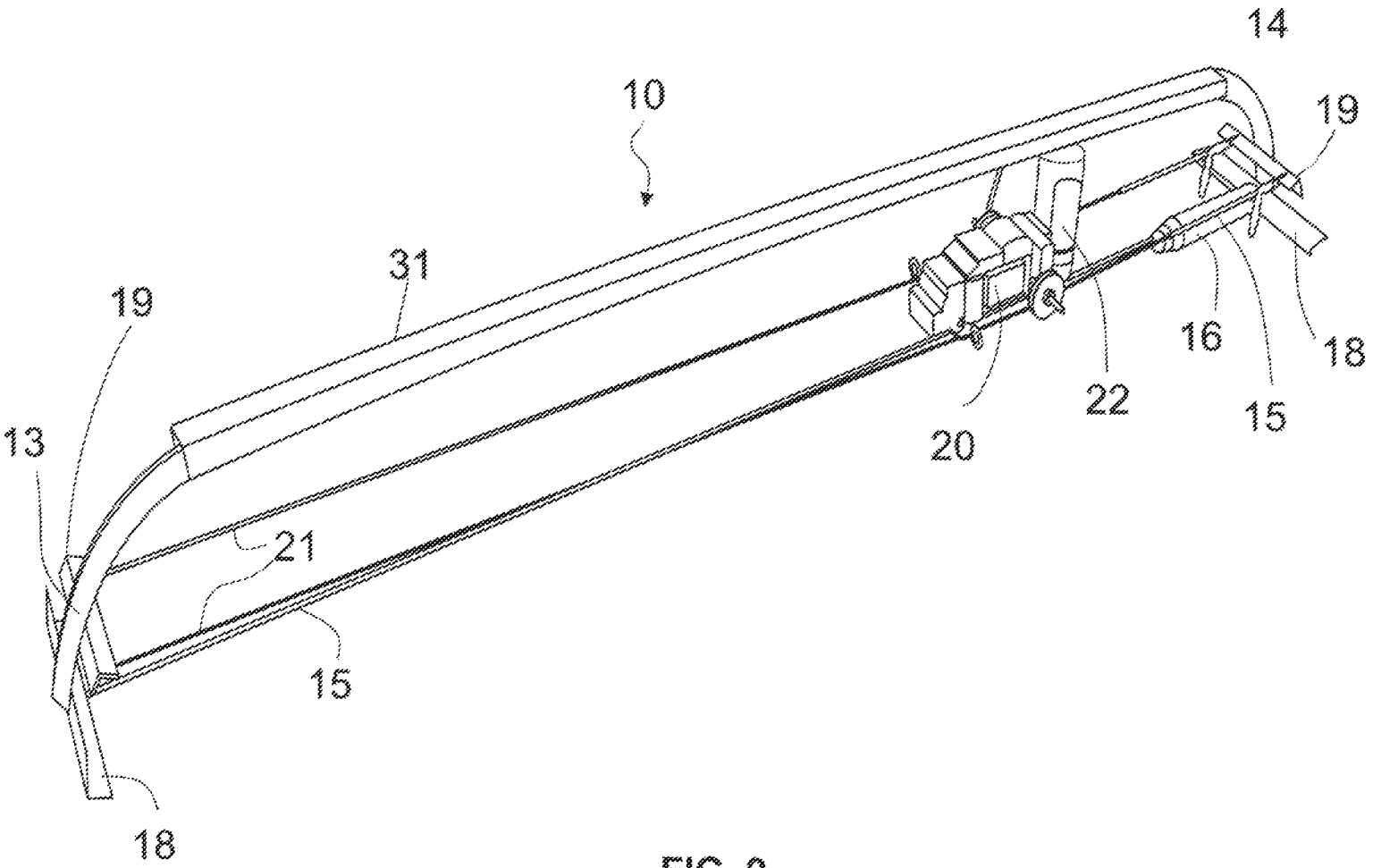
FIG. 9 is a side angle view of the embodiment depicted in FIG. 8 showing the bow shaped support structure with marking string, slidable bullet or shuttle, guide wires, and moveable carriage for marking.

FIGS. 8 and 9 depict another embodiment of the line marking device 10. In this embodiment the bow-shaped support structure 11 having an elongated main body and a first and second curved ends 13, 14. The device 10 may contain one or two horizontal support brackets or support structures 19 attached to the first and second ends 13, 14 respectively of the support structure. The marking string 15 may be fixedly attached at both ends to the first and second ends 13, 14 of the support structure, with a bullet or shuttle 16 containing or being made of marking media 17, being slidably placed along the marking string 15. This embodiment may also contain a movable carriage 20 which is placed along a number of guide wires 21. Two such guide wires 21 are pictured. The guide wires may be drawn taut from one end of the device to the other, allowing the movable carriage 20 to slide or roll along the wires 21 and move freely between both ends. In such an embodiment, the movable carriage may have a reservoir for marking media, and may have an apparatus for spraying or depositing marking media around the marking string, creating an inverse marking line, where the line to be cut falls along the area directly below the marking string 15, which remains unmarked after spraying or deposition.

Herein there also can exist in another embodiment an overhanging sky lift that functions to hold a paint cart within the track. Such paint cart can be remote controlled or manually operated. Therein rests a spray can used for needed markings.

Figure 10:
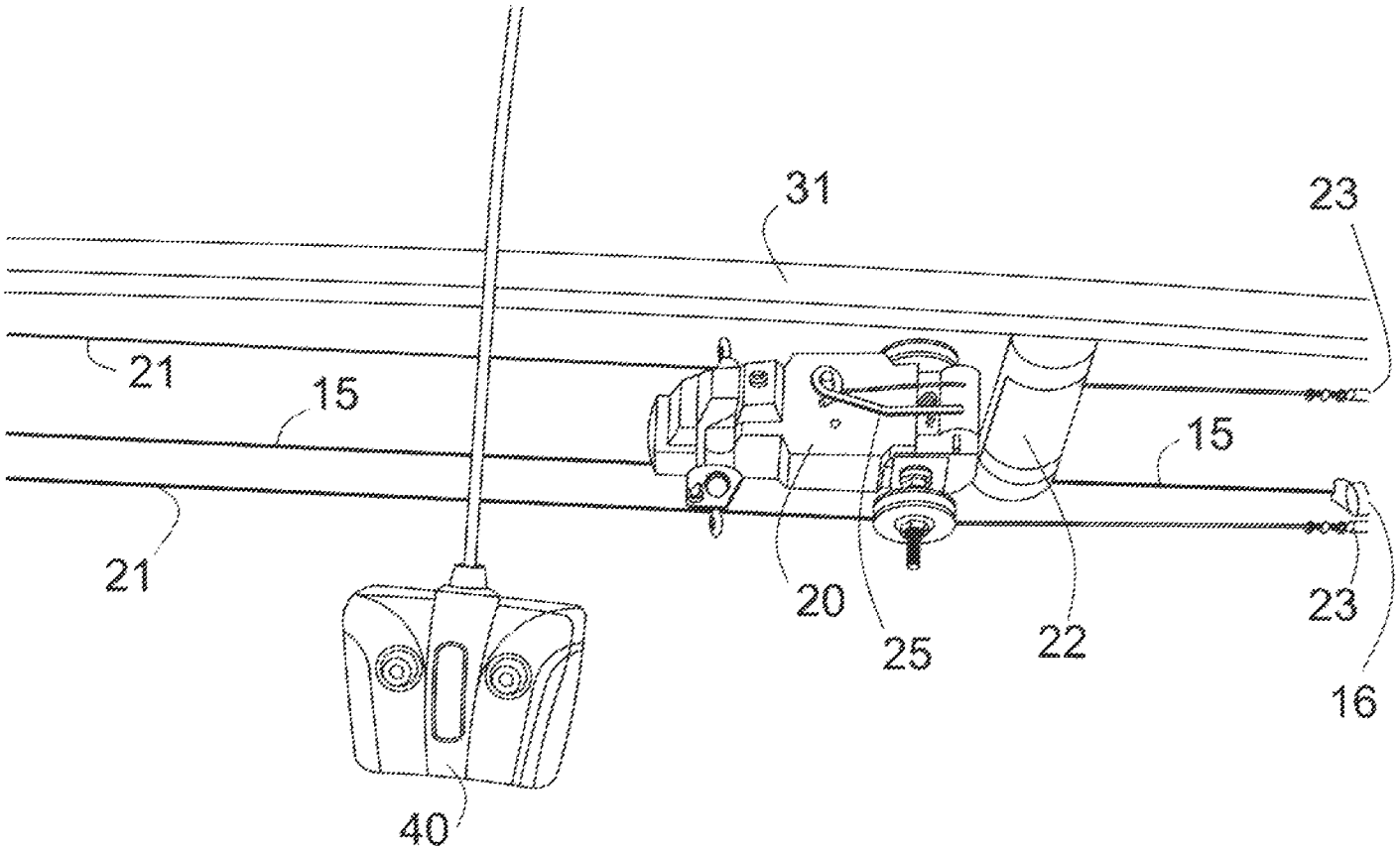
FIG. 10 is another embodiment of the line marking device showing the guide wires and movable carriage, further showing a remote which may be used to control an automated movable carriage for marking a surface along the marking string below the movable carriage.

FIG. 10 shows an embodiment of a movable carriage 20. In such an embodiment, the carriage may roll or slide along the guide wires 21, with sufficient structure to prevent side to side or lateral movement, resulting in a straight line after marking operation. In one embodiment of the marking carriage, the carriage may be automated, and can be operated via remote control, as is depicted in FIG. 10. In another embodiment, the moveable carriage may be operated manually. Such embodiments of the moveable carriage may have a marking reservoir which contains liquid, powder, or aerosol marking media to be sprayed or deposited along the marking string 15 below during marking operation.

Figure 11:
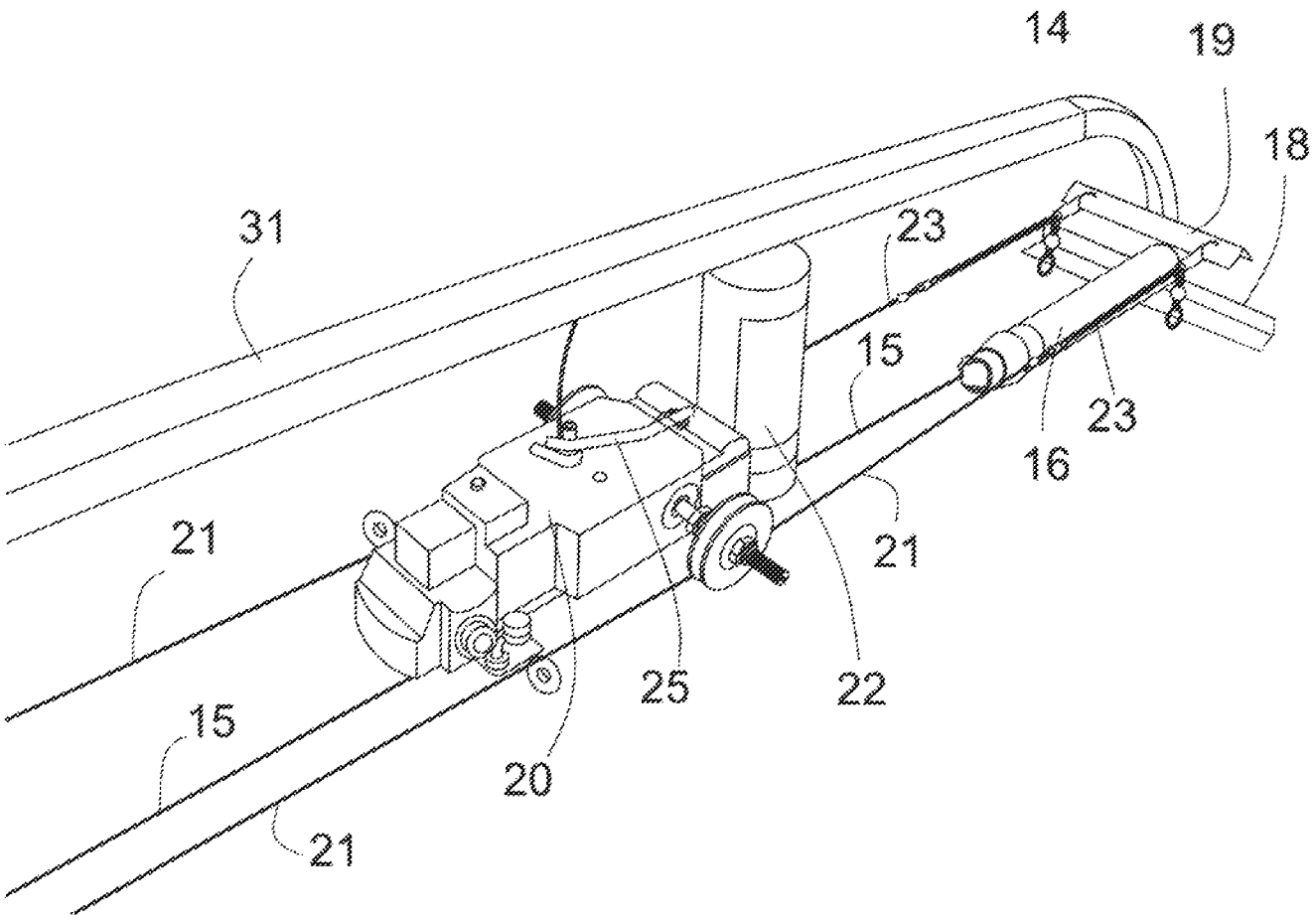
FIG. 11 is a close view of one end of an embodiment of the line marking device showing the bow-shaped support structure, fixed marking string, slidable bullet or shuttle, guide wires, and movable carriage.

FIG. 11 shows another view of an embodiment of a line marking device 10 having a moveable carriage 20, showing the position of the moveable carriage 20 above the marking string 15 and bullet or shuttle 16. In such an embodiment, either the carriage 20 or bullet or shuttle 16 may be used, providing potential for an operator to paint, deposit, or chalk a line, depending on the operator's needs and conditions of the surface to be marked. For example, in cases where a surface to be marked is wet, an operator may prefer to use paint rather than a chalking or powdered media, and would be able to use the carriage deposition method as an alternative to snapping the marking string.

Figure 12:
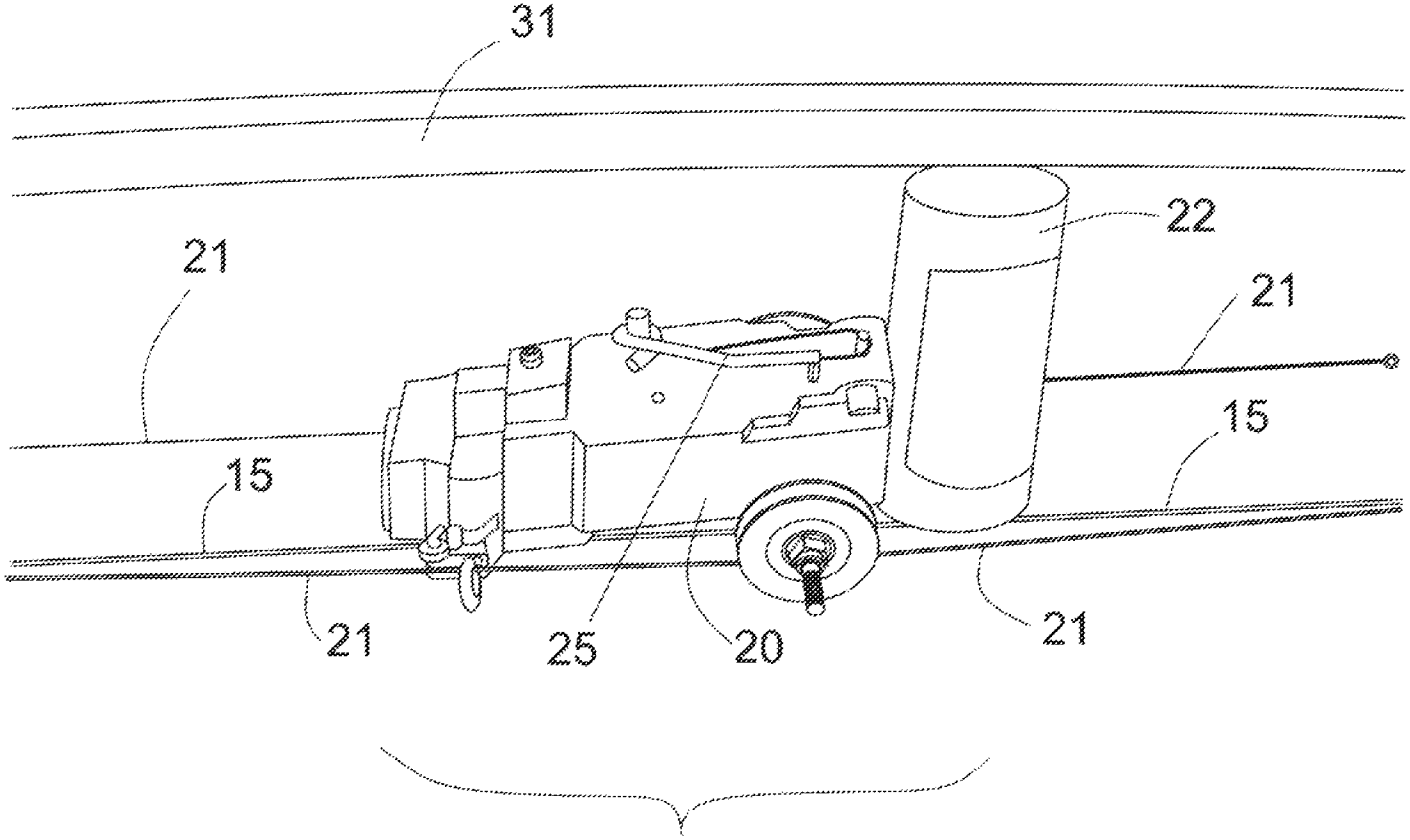
FIG. 12 is another view of the moveable carriage of one embodiment of a line marking device wherein the carriage moves along guide wires carrying line marking media in a reservoir.

FIG. 12 shows a side view of an embodiment of a moveable carriage 20 for marking.

Figure 13:
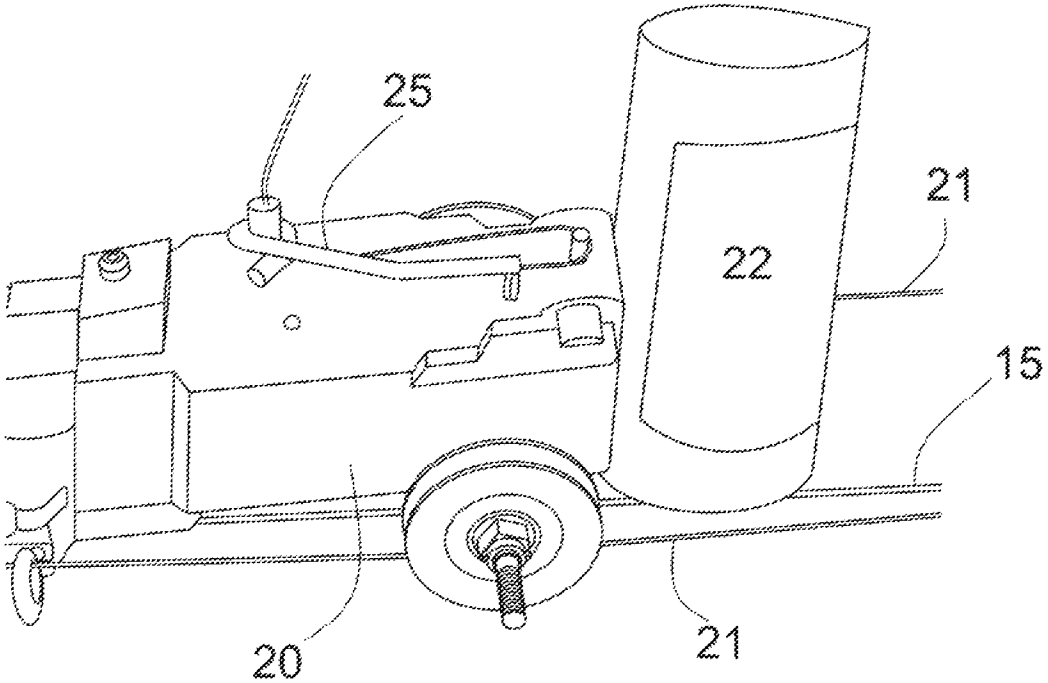
FIG. 13 is a closer view of the moveable carriage of one embodiment of a line marking device showing a closer view of one embodiment of a reservoir for carrying marking media.

FIG. 13 shows a close up view of an embodiment of a moveable carriage 20 for a line marking device. In such an embodiment, the carriage 20 may have a marking media reservoir 22. The reservoir 22 may contain liquid, powder, or aerosol marking media, which may be sprayed or deposited when the moveable carriage is moved along the guide lines. Such an operation would place marking media around the marking string 15 below, leaving an inverse image of the marking string. In such an operation, the operator would be left with an unmarked area directly below the marking string which would operate as a cutting line.

Figure 14:
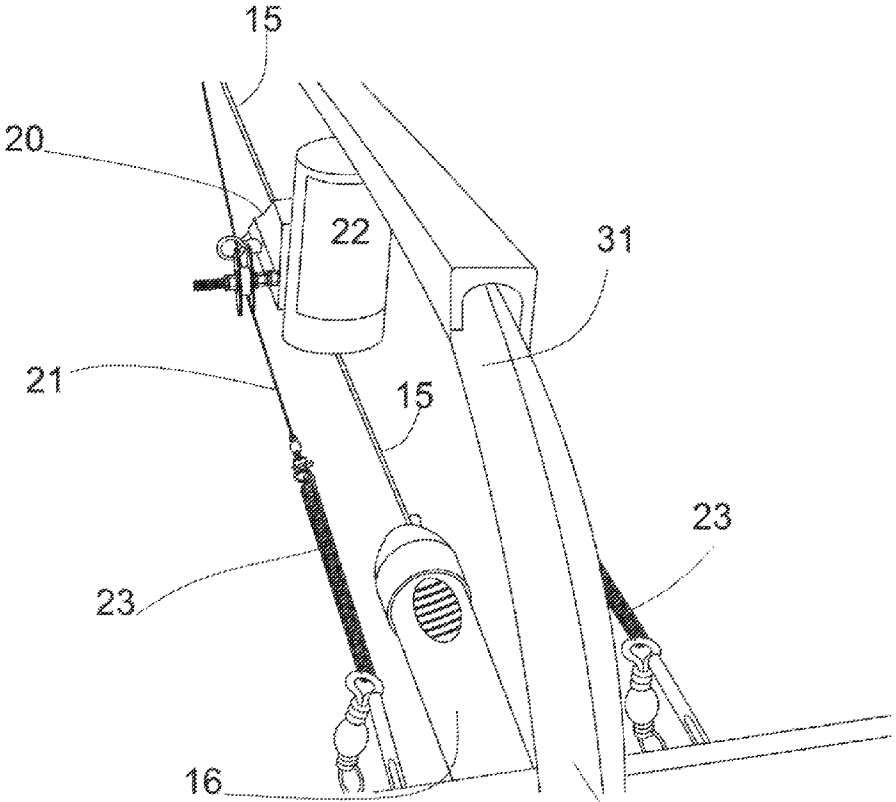
FIG. 14 is an end view of one embodiment of a line marking device showing the bow-shaped support structure, fixed marking string, slidable bullet or shuttle, movable carriage, and guide wires which are attached with springs in order to maintain tension along the line to facilitate limitation of lateral movement of the carriage during marking operation.

FIG. 14 shows an end view of an embodiment of a line marking device in which guide wires 21 for a moveable carriage comprise springs 23 to maintain tension. Other suitable means for maintaining tension in the guide wires may also be used, such as a ratchet or other tightening means.

Figure 15:
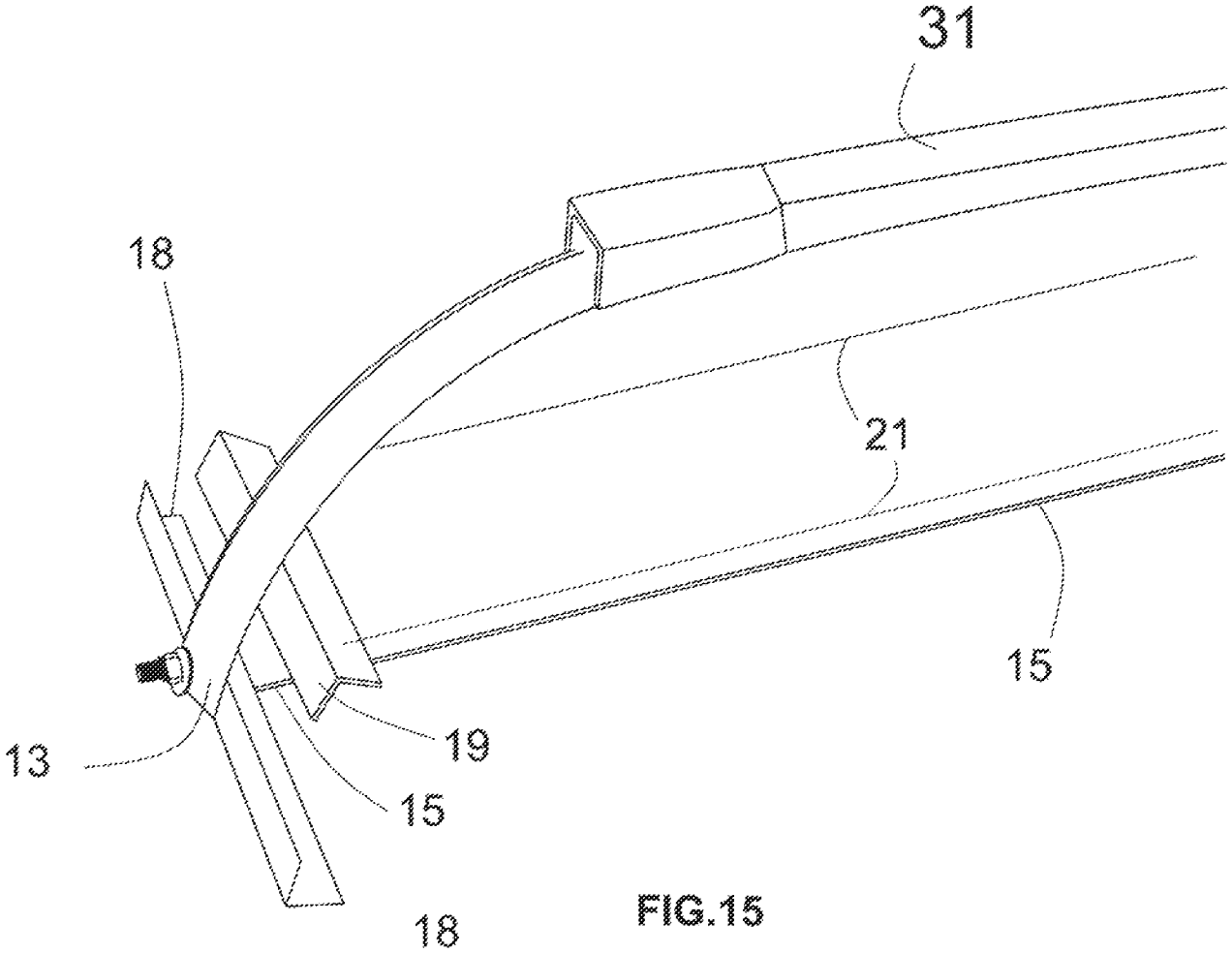
FIG. 15 is a closer view of a second end of an embodiment of a line marking device showing the bow-shaped support structure and horizontal support surface for maintaining a level configuration along a surface to be marked.

FIG. 15 shows one embodiment of a line marking device 10 which has a horizontal mounting bracket or horizontal support surface 19. In one embodiment, the bracket or surface may be fixedly attached to the bow-shaped support structure, allowing an operator to place the line marking device 10 by lowering it from a parallel position to the surface to rest on the surface to be marked. In another embodiment, the horizontal bracket 19 or support surface may be hinged so as to allow an operator to lower the marking device one side at a time, allowing the operator to align the device accordingly as he places the device along the surface to be marked.

Figure 16:
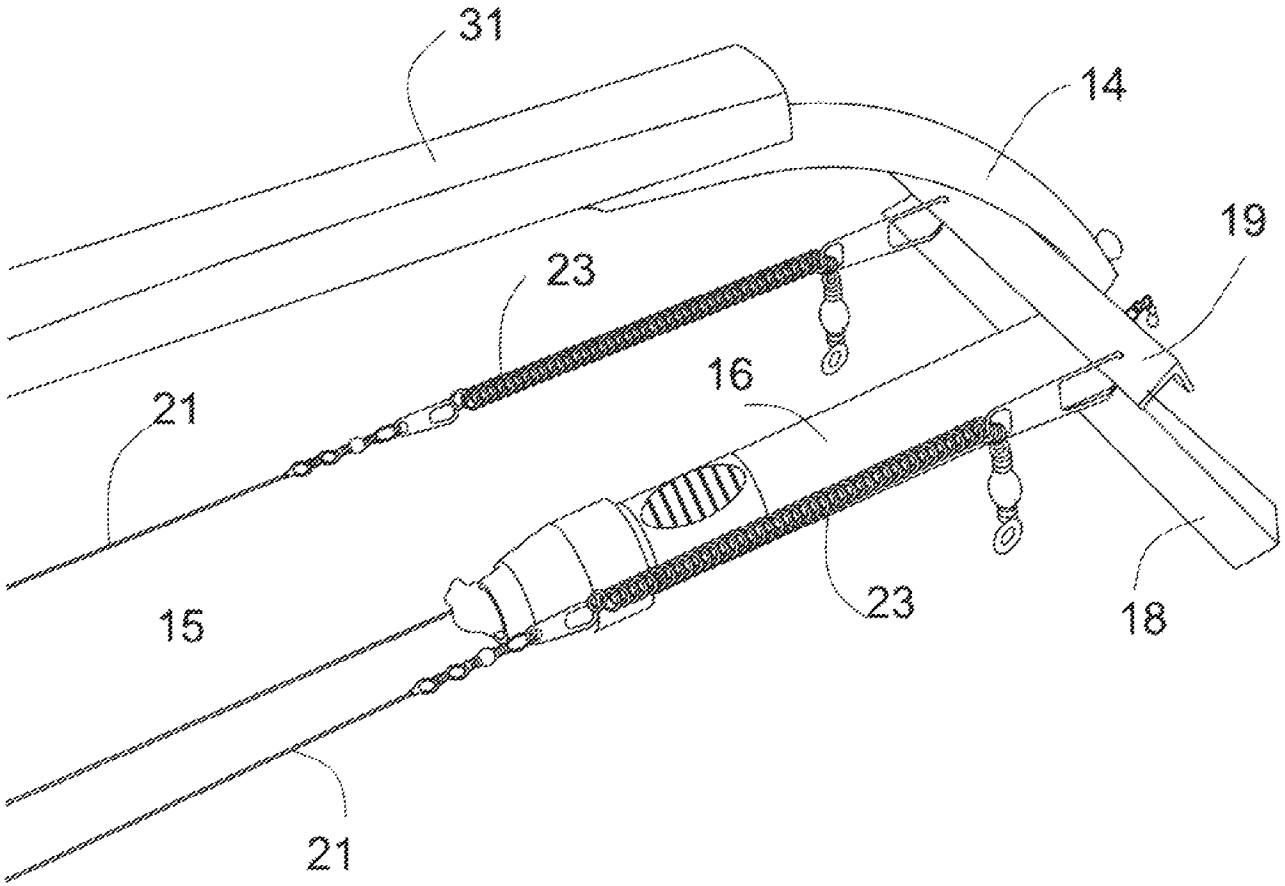
FIG. 16 is a close-up view of a first end of an embodiment of a line marking device showing the bow-shaped support structure, horizontal support surface for maintaining a level configuration along a surface to be marked, a fixed marking string, a slidable bullet or shuttle containing marking media, guide wires, and a spring configuration for maintaining tension in the guide wires

FIG. 16 shows an additional view of an embodiment of a line marking device 10 which has a horizontal mounting bracket 19 or horizontal support surface. FIG. 16 depicts an embodiment which may have such a feature in addition to guide wires 21 for a moveable carriage 20 as well as a slidable bullet or shuttle 16 along a marking string 15. Such features in some embodiments may be present in addition to or in the absence of any of other such features.

Figure 17:
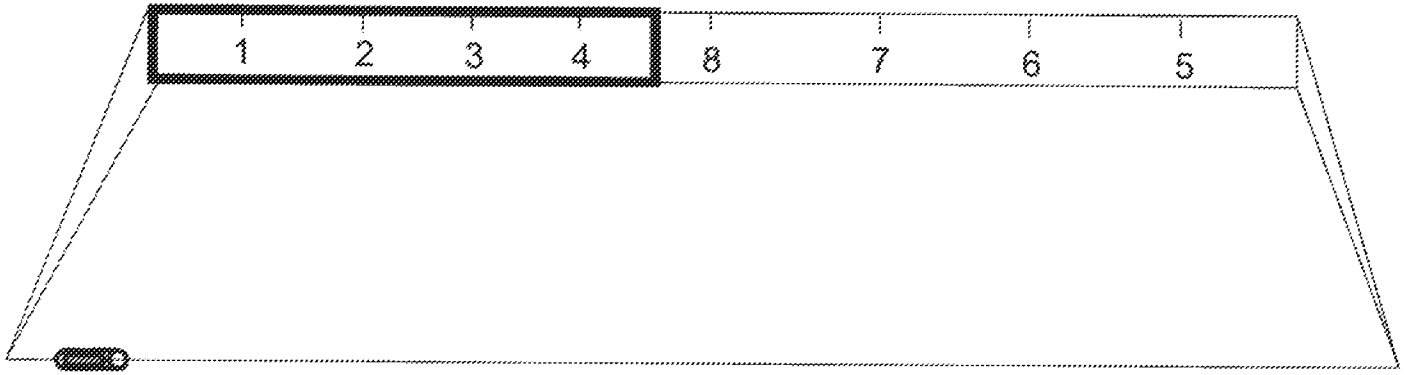
FIG. 17 shows a variation of the embodiment wherein there is seen a telescoping measurement mode

FIG. 17 shows a variation of the embodiment wherein there is seen a telescoping measurement mode wherein the measurement device can clearly be interpreted.

Figure 18:
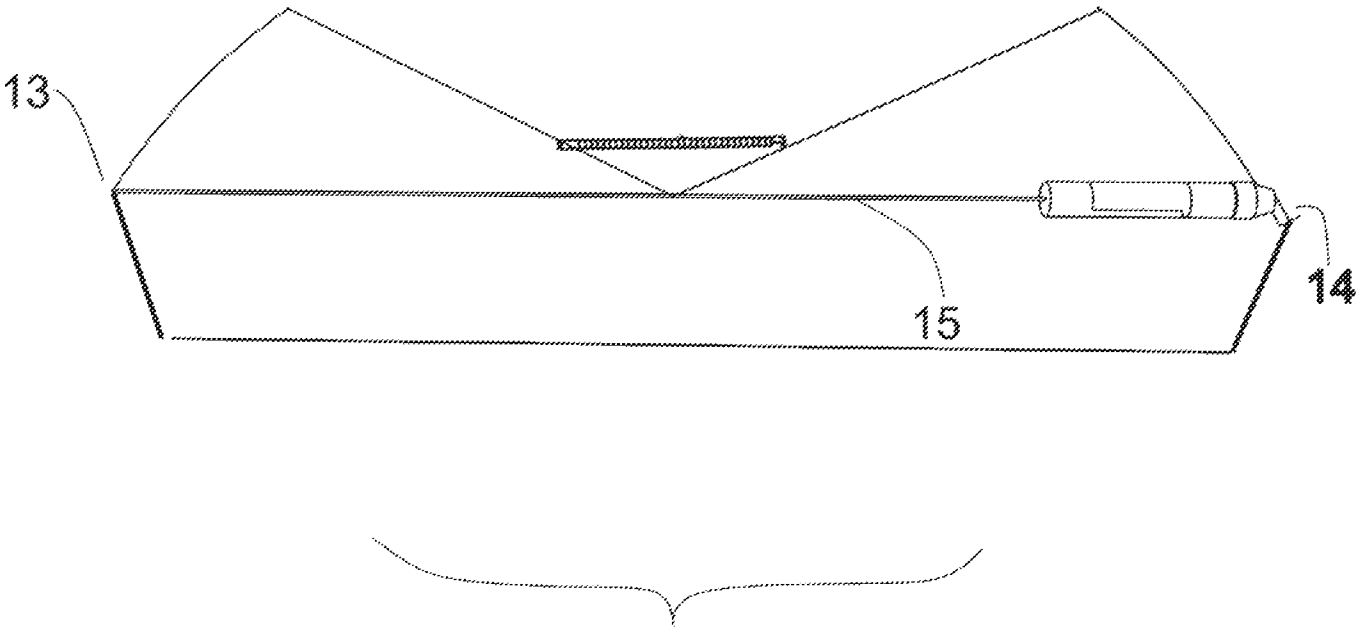
FIG. 18 shows a variation of the embodiment that can be used during roofing.

FIG. 18 shows a variation of the embodiment that can be used during roofing. Herein there is a telescoping frame that has a spring holding outward tension device located centrally to achieve 90 degree angel pivots in an outward direction at the far reaches of said device. Tension wires are situated thereunder at a proximal 35 degree angular bend.

Whereas particular embodiments of this invention have been described above for purposes of illustration, it will be evident to those skilled in the art that numerous variations of the details of the present invention may be made without departing from the invention.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A line marking device comprising:

a bow-shaped support structure having a first and second ends;

a continuous marking string slidably attached to said support structure forming a closed loop with no free end, a portion of said marking string extending lengthwise along a shortest distance between said first and second ends of said support structure forming a straight line for producing straight lines on a working surface; and a shuttle of marking media fixedly attached to said second end of said support structure, said marking string extending through said shuttle of marking media, said marking media impregnating said marking string as said marking string passes through said shuttle of marking media;

wherein said marking media that is picked up by said marking string is transferred to the working surface to produce straight lines as said marking string is pulled away from the working surface and then released towards the working surface.

2. The line marking device of claim 1, further comprising a horizontal placement bracket attached to said first end of said bow-shaped support structure such that a flat surface of said placement bracket lies in a plane perpendicular to said support structure and parallel to the working surface to ultimately engage the working surface.

3. The line marking device of claim 2, wherein said shuttle is made of a solid marking material for direct deposition of marking media onto said continuous marking string as said marking string passes through said shuttle.

4. The line marking device of claim 2, wherein said shuttle contains a powdered or liquid marking media within an absorbent material or within a hollow shell, said shuttle being closed at both ends with a soft or spongy material which prevents free pouring of the marking media and prevents lateral movement of the shuttle in directions other than parallel to said marking string.

5. The line marking device of claim 1, wherein said shuttle is in a breakaway or removable configuration to facilitate reloading or replacement of said marking media when said marking media becomes depleted or said shuttle is integrally formed around said marking line without means for removal.

6. The line marking device of claim 1, wherein said support structure lies in a plane perpendicular to the working surface and above said marking string in relation to the working surface.

7. The line marking device of claim 6, further comprising:

a number of guide wires;

a movable carriage which is placed along said guide wires which are designed to drawn taut from one end of said support structure to the other allowing said movable carriage to slide or roll along said guide wires and move freely between said first and second ends of support structure; and a tightening means for maintaining tension in the guide wires;

wherein said movable carriage has a reservoir to contain liquid, powder, or aerosol marking media to be sprayed or deposited along said marking string.

8. The line marking device of claim 7, further comprising an apparatus for spraying or depositing marking media around said marking string, creating an inverse image of said marking string.

9. The line marking device of claim 8, further comprising a remote control for remotely controlling said carriage.

10. The line marking device of claim 9, wherein tightening means for maintaining tension in said guide wires is selected from the group consisting of spring and ratchet.

11. A line marking device comprising:

a bow-shaped support structure having an elongated main body and a first and second curved ends;

a marking string fixedly attached at both ends to said first and second ends of said support structure forming a lengthwise straight line along a shortest distance between said first and second ends of said support structure for marking a working surface;

a shuttle carrying a supply of marking media slidably attached to said marking string, said marking string extending through said shuttle and said supply of marking media carried by said shuttle; said marking media impregnating said marking string as said shuttle travel back and forth between said first and second ends of support structure; and wherein said marking media that is picked up by said marking string is transferred to the working surface to produce straight lines as said marking string is pulled away from the working surface and then released towards the working surface.

12. The line marking device of claim 11 further comprising two horizontal placement brackets which are fixedly or hingedly attached to said first and second ends of said support structure respectively such that a flat surface of said horizontal placement brackets lies in a plane perpendicular to said support structure and parallel to the working surface.

13. The line marking device of claim 12, wherein said shuttle is made of a solid marking material for direct deposition of marking media onto said continuous marking string as said marking string passes through said shuttle.

14. The line marking device of claim 12, wherein said shuttle contains a powdered or liquid marking media within an absorbent material or within a hollow shell, said shuttle being closed at both ends with a soft or spongy material which prevents free pouring of the marking media and prevents lateral movement of the shuttle in directions other than parallel to said marking string.

15. The line marking device of claim 1, wherein said shuttle is in a breakaway or removable configuration to facilitate reloading or replacement of said marking media when said marking media becomes depleted or said shuttle is integrally formed around said marking line without means for removal.

16. The line marking device of claim 11, wherein said support structure lies in a plane perpendicular to the working surface and above said marking string in relation to the working surface.

17. The line marking device of claim 16, further comprising:

a number of guide wires;

a movable carriage which is placed along said guide wires which are designed to drawn taut from one end of said support structure to the other allowing said movable carriage to slide or roll along said guide wires and move freely between said first and second ends of support structure; and a tightening means for maintaining tension in the guide wires;

wherein said movable carriage has a reservoir to contain liquid, powder, or aerosol marking media to be sprayed or deposited along said marking string.

18. The line marking device of claim 17, further comprising an apparatus for spraying or depositing marking media around said marking string, creating an inverse image of said marking string.

19. The line marking device of claim 18, further comprising a remote control for remotely controlling said carriage.

20. The line marking device of claim 19, wherein tightening means for maintaining tension in said guide wires is selected from the group consisting of spring and ratchet.

* * * * *